US008966844B2

(12) United States Patent
Bouchard

(10) Patent No.: US 8,966,844 B2
(45) Date of Patent: Mar. 3, 2015

(54) MASONRY WALL SYSTEM WITH GUIDING MEANS

(71) Applicant: Oldcastle Building Products Canada, Inc., Ville D'Anjou (CA)

(72) Inventor: Michel Bouchard, Riviere-des-Prairies (CA)

(73) Assignee: Oldcastle Building Products Canada, Inc. (CA)

( * ) Notice: Subject to any disclaimer, the term of this patent is extended or adjusted under 35 U.S.C. 154(b) by 13 days.

(21) Appl. No.: 14/083,122

(22) Filed: Nov. 18, 2013

(65) Prior Publication Data

US 2014/0075873 A1 Mar. 20, 2014

Related U.S. Application Data

(63) Continuation of application No. 12/865,180, filed as application No. PCT/CA2009/000118 on Jan. 30, 2009, now Pat. No. 8,621,801.

(60) Provisional application No. 61/025,476, filed on Feb. 1, 2008.

(51) Int. Cl.
*E04C 1/00* (2006.01)
*E04B 2/72* (2006.01)
(Continued)

(52) U.S. Cl.
CPC ..... *E04F 13/0862* (2013.01); *E04B 2/721* (2013.01); *E04F 13/14* (2013.01); *E04B 2/46* (2013.01); *E04G 9/10* (2013.01)
USPC ..... 52/314; 52/315; 52/390; 52/392; 52/747.1

(58) Field of Classification Search
CPC ... E04F 13/0862; E04F 13/14; E04F 13/0801; E04F 13/0803; E04F 13/088; E04F 13/0885; E04F 13/147
USPC ..... 52/366, 384, 385, 386, 387, 389, 390, 52/392, 311.1, 314, 315, 510, 555
See application file for complete search history.

(56) References Cited

U.S. PATENT DOCUMENTS 438,229 A 10/1890 Elterich
658,868 A 10/1900 Rosenbaum
(Continued)

FOREIGN PATENT DOCUMENTS

CA 2211511 2/1988
CA 2387181 11/2003
(Continued)

OTHER PUBLICATIONS

International Search Report dated May 12, 2009 in related International Application No. PCT/CA2009/000118.
(Continued)

*Primary Examiner* — Robert Canfield
*Assistant Examiner* — Matthew Gitlin
(74) *Attorney, Agent, or Firm* — Kilpatrick Townsend & Stockton LLP

(57) ABSTRACT

The present invention concerns a masonry wall system consisting of a plurality of panels and artificial masonry units. The panels are provided with channels sized to receive the artificial masonry units and delimited by protruding ribs. The protruding ribs have a predetermined width w and also have notches uniformly spaced along the ribs. The artificial masonry units have protuberances devised and positioned on the masonry units to be fitted in the notches of the protruding ribs so that the masonry units are equally spaced-apart from each other by a predetermined gap (g).

12 Claims, 11 Drawing Sheets

(51) Int. Cl.

| | |
|---|---|
| ***E04F 13/08*** | (2006.01) |
| ***E04F 13/14*** | (2006.01) |
| ***E04B 2/46*** | (2006.01) |
| ***E04G 9/10*** | (2006.01) |

(56) References Cited

U.S. PATENT DOCUMENTS

| | | | |
|---|---|---|---|
| 1,502,681 | A | 7/1924 | Pommersheim |
| 1,673,630 | A | 6/1928 | Madge |
| 1,704,035 | A | 3/1929 | Cochran |
| 1,707,347 | A | 4/1929 | Dunbar |
| 1,806,113 | A | 5/1931 | Oscar |
| 1,850,961 | A | 3/1932 | Mortenson |
| 1,861,359 | A | 5/1932 | Frank |
| 2,005,030 | A | 6/1935 | Geisinger |
| 2,016,918 | A | 10/1935 | Born |
| 2,043,706 | A | 6/1936 | Myers |
| 2,097,069 | A | 10/1937 | Klages |
| 2,135,118 | A | 11/1938 | Stewart |
| 2,198,466 | A | 4/1940 | Stolze |
| 2,832,102 | A | 4/1958 | Joseph |
| 2,882,713 | A | 4/1959 | Diehl |
| 2,924,963 | A | 2/1960 | Taylor |
| 2,938,376 | A | 5/1960 | Workman et al. |
| 3,005,293 | A | 10/1961 | Hunter |
| 3,131,513 | A | 5/1964 | Grigas |
| 3,321,883 | A | 5/1967 | Pascucci |
| 3,421,278 | A | 1/1969 | Christ-Janer |
| 3,496,694 | A | 2/1970 | Hicks et al. |
| 3,596,420 | A | 8/1971 | Ducker |
| 3,712,825 | A | 1/1973 | Yocum |
| 3,908,326 | A | 9/1975 | Francis |
| 4,011,702 | A | 3/1977 | Matyas |
| 4,141,525 | A | 2/1979 | Miller |
| 4,238,915 | A | 12/1980 | Yoshida et al. |
| 4,242,299 | A | 12/1980 | Adams |
| 4,441,297 | A | 4/1984 | Rijnders |
| 4,478,021 | A | 10/1984 | Person |
| 4,589,241 | A | 5/1986 | Volpenhein |
| 4,662,140 | A | 5/1987 | Porter et al. |
| 4,773,201 | A | 9/1988 | Trezza |
| 4,809,470 | A | 3/1989 | Bauer et al. |
| 4,856,245 | A | 8/1989 | Osawa |
| 4,856,246 | A | 8/1989 | Shimasaki |
| 4,888,928 | A | 12/1989 | Rea et al. |
| 4,890,433 | A | 1/1990 | Funaki |
| D306,907 | S | 3/1990 | Trezza |
| 4,916,875 | A | 4/1990 | Kashiwagi |
| 4,987,712 | A | 1/1991 | Mancuso |
| 5,228,937 | A | 7/1993 | Passeno |
| 5,423,155 | A | 6/1995 | Bauer |
| 5,501,049 | A | 3/1996 | Francis et al. |
| RE35,380 | E | 11/1996 | Rea et al. |
| 5,815,986 | A | 10/1998 | Laska |
| 5,815,989 | A | 10/1998 | Bennenk et al. |
| 5,822,937 | A | 10/1998 | Mahony et al. |
| 5,855,075 | A | 1/1999 | Digiovanni |
| 5,894,676 | A | 4/1999 | DiGiovanni |
| 6,098,363 | A | 8/2000 | Yaguchi |
| 6,164,037 | A | 12/2000 | Passeno |
| 6,315,489 | B1 | 11/2001 | Watanabe |
| 6,802,165 | B1 | 10/2004 | Passeno |
| 6,857,248 | B2 | 2/2005 | Ouellet et al. |
| 6,990,778 | B2 | 1/2006 | Passeno |
| 7,121,051 | B2 | 10/2006 | Hunsaker |
| D539,927 | S | 4/2007 | Whitson |
| D578,224 | S | 10/2008 | Lacas |
| D579,576 | S | 10/2008 | Lacas |
| D584,834 | S | 1/2009 | Lacas |
| 7,658,050 | B2 | 2/2010 | Bouchard |
| D615,216 | S | 5/2010 | Jacot et al. |
| D633,630 | S | 3/2011 | Jacot et al. |
| 8,042,309 | B2 | 10/2011 | Wolf et al. |
| 8,096,091 | B2 | 1/2012 | Cristina |
| 8,101,113 | B2 | 1/2012 | Castonguay et al. |
| 8,141,310 | B2 | 3/2012 | Trezza |
| D659,263 | S | 5/2012 | Jacot et al. |
| 8,322,103 | B1 | 12/2012 | Kownacki |
| 8,438,893 | B2 | 5/2013 | Durney et al. |
| 8,621,801 | B2 | 1/2014 | Bouchard et al. |
| 8,627,625 | B2 | 1/2014 | Bouchard et al. |
| 2003/0037586 | A1 | 2/2003 | Durney et al. |
| 2004/0050003 | A1 | 3/2004 | Passeno |
| 2004/0065035 | A1 | 4/2004 | De Vlam |
| 2004/0206152 | A1 | 10/2004 | Durney et al. |
| 2005/0028476 | A1 | 2/2005 | Bouchard |
| 2005/0064138 | A1 | 3/2005 | Durney et al. |
| 2005/0284063 | A1 | 12/2005 | Losse |
| 2006/0249881 | A1 | 11/2006 | Castonguay et al. |
| 2007/0193176 | A1 | 8/2007 | Bouchard et al. |
| 2008/0155922 | A1 | 7/2008 | Wolf et al. |
| 2012/0085052 | A1 | 4/2012 | Bouchard et al. |
| 2012/0117904 | A1 | 5/2012 | Bouchard et al. |

FOREIGN PATENT DOCUMENTS

| | | |
|---|---|---|
| EP | 0390547 | 10/1990 |
| GB | 2245619 | 1/1992 |
| GB | 2371314 | 7/2002 |
| JP | 2001132194 | 5/2001 |
| WO | WO-9305251 | 3/1993 |
| WO | WO 9922091 | 5/1999 |
| WO | WO-2009094778 | 8/2009 |
| WO | WO-2010085894 | 8/2010 |
| WO | WO-2011011891 | 2/2011 |

OTHER PUBLICATIONS

International Search Report dated Nov. 29, 2010 in related International Application No. PCT/CA2010/001191.

International Preliminary Report on Patentability dated Aug. 3, 2010 in related International Application No. PCT/CA2009/000118.

International Preliminary Report on on Patentability dated Jan. 3, 2012 in related International Application No. PCT/CA2010/001191.

International Search Report dated Apr. 26, 2010 in related International Application No. PCT/CA2010/000133.

International Preliminary Report on on Patentability dated Aug. 2, 2011 in related International Application No. PCT/CA2010/000133.

Restriction Requirement in Related U.S. Appl. No. 13/146,929 dated Feb. 19, 2013, 7 pages.

Response in Related U.S. Appl. No. 13/146,929 dated Apr. 19, 2013, 3 pages.

Response in Related U.S. Appl. No. 13/146,929 dated Aug. 28, 2013, 12 pages.

Office Action in Related U.S. Appl. No. 13/146,929 dated May 28, 2013, 20 pages.

Notice of Allowance in Related U.S. Appl. No. 12/865,180 dated Aug. 16, 2013, 11 pages.

Notice of Allowance in Related U.S. Appl. No. 13/146,929 dated Sep. 10, 2013, 7 pages.

Restriction Requirement in related U.S. Appl. No. 13/387,350 dated Oct. 3, 2013, 7 pages.

Notice of Allowance in related U.S. Appl. No. 14/102,261 dated Oct. 27, 2014, 17 pages.

Fig. 4
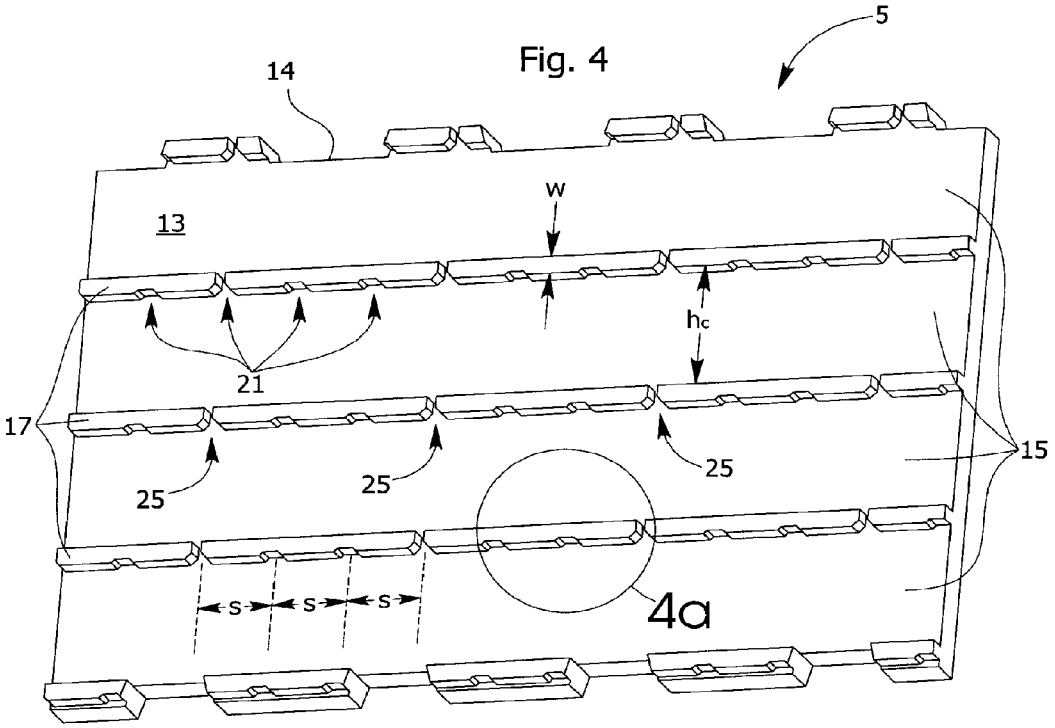
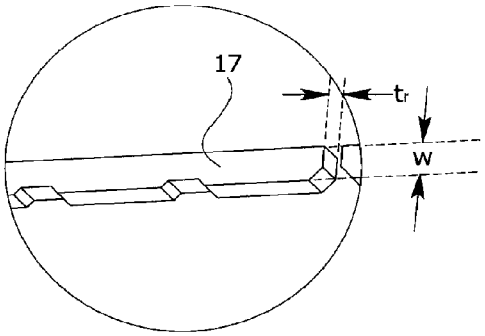
Fig. 4a

Fig. 8
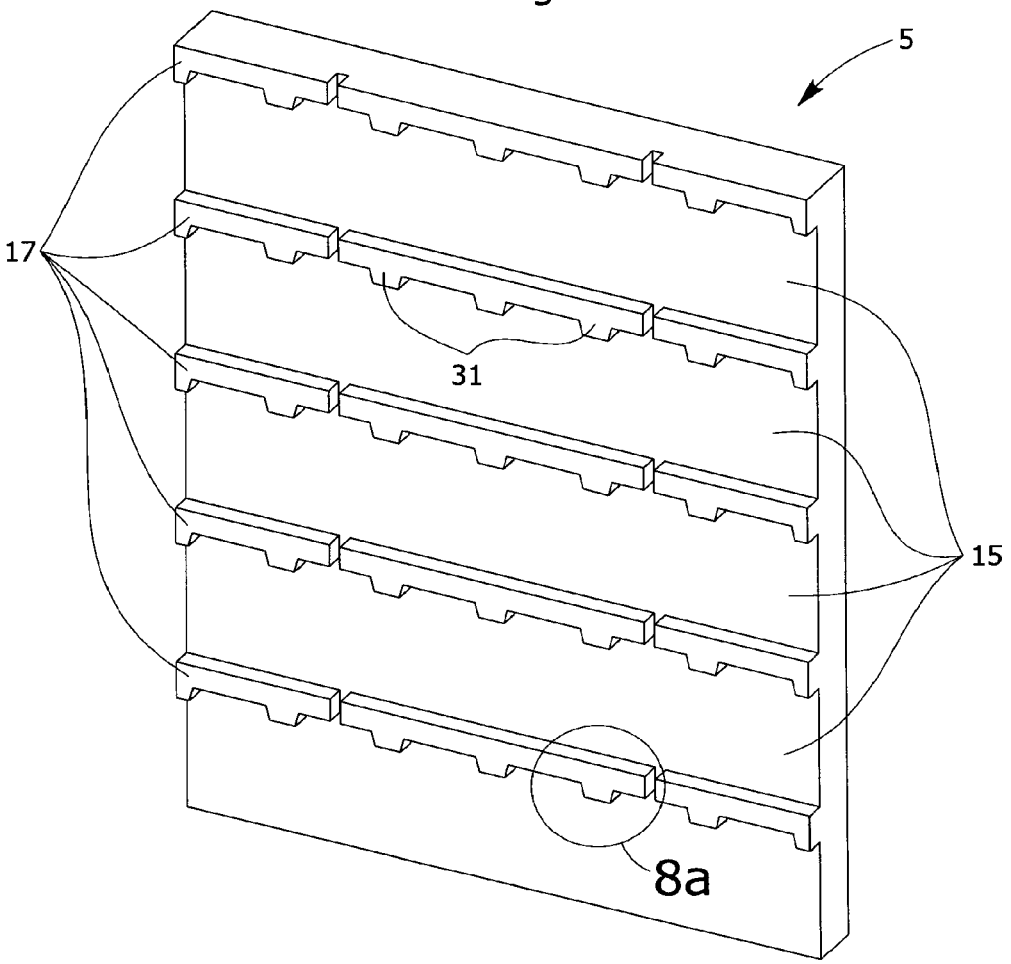
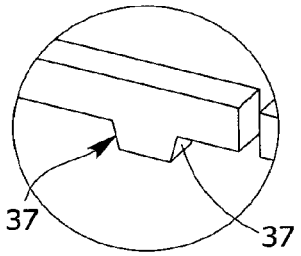
Fig. 8a

MASONRY WALL SYSTEM WITH GUIDING MEANS

CROSS REFERENCE TO RELATED APPLICATIONS

This application is a continuation of U.S. patent application Ser. No. 12/865,180, filed on Jul. 29, 2010, now allowed, which is a U.S. national phase of International Application No. PCT/CA2009/000118 filed on Jan. 30, 2009 and published on Aug. 6, 2009 as International Publication No. WO 2009/094778 A1, which application claims priority to and the benefit of U.S. Provisional Patent Application No. 61/025,476, filed on Feb. 1, 2008, the contents of all of which are incorporated herein by reference in their entireties.

FIELD OF THE INVENTION

The present invention relates to the field of masonry works and installations. More particularly, it concerns a system including panels and a plurality of masonry units, the panels and the masonry units being provided with guiding means for positioning the masonry units.

PRIOR ART

Already known in the prior art, there is the masonry wall system disclosed in US20070193176 in the name of the Applicant, which system makes it possible to easily and rapidly build an artificial masonry wall without having to use a mixture of cement to temporarily retain the masonry units while building the wall.

More specifically, US20070193176 provides a panel, preferably made of a compressible material, having a front face provided with masonry unit receiving depressions bordered by protruding ribs. The depressions of different sizes are adapted to receive respective artificial masonry units in a close-fitting relationship. Each of the artificial masonry units comprises a tooth projection for thrusting into the protruding rib when the masonry unit is inserted in a respective depression.

In this prior art system, a masonry unit having a specific size can only fit in a corresponding panel receiving depression and therefore each panel of the system can only have one predetermined pattern. If one wants a different type of stonework or brickwork pattern, different panels must be designed and used. In other words, it is not possible to create different types of patterns with a single type of panel.

Also known is U.S. Pat. No. 4,809,470 (BAUER et al.) which describes a panel system and a method for facilitating the construction of brick facades. The system includes panels, the outer surface of the panel being provided with horizontal channel bars configured to secure bricks in place by a friction fit until mortar is laid. BAUER discloses that the channel bars separate the bricks in a vertical direction while other spacing means are used to locate the bricks in the horizontal direction in a proper distance from one another. However no other details are provided on how these other spacing means are devised or used, other than they are used for spacing the bricks properly.

Application GB 2,245,619 (THURSTON) describes a system including a cladding sheet provided with locating means and a plurality of artificial bricks provided with complementary locating means corresponding to the locating means on the sheet. The locating means are described as pairs of slots complementary to notches disposed at the back and on the sides of the bricks. Even if this system helps positioning the bricks evenly onto the cladding sheet, the bricks can only be placed in restricted positions (either horizontally or vertically) within the cladding sheet and only allow for one specific size of bricks. No indication is given that the spacing between two bricks corresponds to a predetermined spacing, or that artificial bricks having different sizes can be used with the cladding sheet.

The following prior art documents provide other examples of wall construction using panels and/or masonry units: U.S. Pat. Nos. 3,496,694; 3,712,825; 3,908,326; 4,589,241; 5,228,937; 5,501,049; 5,894,676, 6,164,037; U.S. Pat. No. 7,121,051; and PCT application WO 1999/022091.

In light of the aforementioned, it would be desirable for a masonry wall system to allow persons with limited or no masonry skills to easily create different stonework or brickwork patterns that give the impression of having been made by a skilled mason, and that, with a single type of panels.

SUMMARY OF THE INVENTION

It is an object of the present invention to provide a masonry wall system that satisfies the above mentioned need.

Therefore, in accordance with the present invention, there is provided a system for building a masonry wall on a building surface. The system includes a plurality of artificial masonry units. Each one of the masonry units has a front face, a back face, and two pairs of parallel lateral faces having a thickness $t_m$. The system also includes at least one panel having a front face provided with a plurality of horizontally extending channels. The channels are delimited by protruding ribs for receiving rows of artificial masonry units in the channels. The ribs have a predetermined thickness ($t_r$) smaller that the thickness ($t_m$) of the masonry units. Rib guiding means are positioned along the ribs and unit guiding means are positioned along one of the lateral faces of the masonry units. The rib and unit guiding means are interdependently positioned for guiding the installation of the masonry units in the channels so that the masonry units be equally spaced-apart by a predetermined gap (g).

As can be appreciated, the guiding means facilitate the placement of masonry units on the wall so that the vertical spacing between adjacent bricks is always identical and equal to a predetermined gap (g).

More specifically, each one of the channels is delimited by an upper rib and a lower rib, and in a preferred embodiment of the invention, the rib guiding means are arranged along one of the upper and lower rib, the rib guiding means facing the channel and being uniformly spaced therealong by a spacing (s) corresponding to Ag, wherein A is an integer equal to or greater than 1. Each one of the masonry units has a length, delimited by two opposing vertical edges, and corresponding to Bg, wherein B is a second integer equal to or greater than 2. Each artificial unit includes at least one unit guiding means, adapted to be coupled with one of the rib guiding means when the masonry unit is fitted in the channel. The unit guiding means is located such that a unit guiding means position (p) from one of the two opposing edges corresponds to (X+C)g, wherein X is a nonnegative real number and wherein C is a third integer multiple of A.

In a preferred embodiment of the invention, the ribs have a predetermined width (w) and the gap (g) between the masonry units is substantially equal to the predetermined width (w) of the ribs By substantially, it is meant a tolerance of ±15%. In this embodiment, the vertical spacing between adjacent bricks equals the predetermined horizontal gap g, which gap can be chosen so as to correspond to the standard spacing used in traditional masonry.

Throughout the present document, a "multiple" of an integer is defined as the product of that integer with another integer. In other words, a is a multiple of b if a=nb, where n is an integer. A multiple of an integer is obtained by multiplying the integer by any natural number and it is considered that "0" is a multiple of every integer.

In accordance with another aspect of the present invention, there is also provided a method for making a masonry wall covering a building surface, comprising the steps of:

a) mounting side by side on the building surface a plurality of panels, each panel having a front face provided with a plurality of horizontally extending channels delimited by protruding ribs provided with rib guiding means being positioned along the ribs;

b) providing a plurality of artificial masonry units, each one of said masonry units having a front face, a back face, and two pairs of parallel lateral faces having a thickness $t_m$, unit guiding means being positioned along one of the lateral faces of the masonry units, said rib and unit guiding means being interdependently positioned; and c) forming rows of side by side masonry units by inserting in each of the channels a number of the plurality of masonry units, each of the masonry units being positioned by coupling the unit guiding means of each masonry unit with one rib guiding means of the protruding ribs to form rows of masonry units spaced apart from each other by a predetermined gap.

In another preferred embodiment, the artificial masonry units can be of various sizes and they may be placed horizontally or vertically in a panel.

Preferably, each of the rib guiding means is interlockable with each of the unit guiding means, for providing a mechanical connection of the units with the ribs of the panel. By "interlockable", it is meant that the rib guiding means can be connected with the unit guiding means, so that the rib and unit are locked or closely united. By "mechanical connection", it is meant that the connection relates to or is dominated by physical forces. In other words, there is a physical contact between the rib guiding means and the unit guiding means.

Still preferably, the rib guiding means are notches and the unit guiding means are protuberances shaped to snugly fit into the notches.

Further aspects and advantages of the present invention will be better understood upon reading of preferred embodiments thereof with respect to the appended drawings.

BRIEF DESCRIPTION OF THE DRAWINGS

FIG. 3*a* is a partial front view of a masonry wall system according to yet another embodiment of the invention, as it appears to one facing the wall, while

FIG. 4 is a perspective view of the masonry wall panel of FIG. 3*a* with the masonry units removed. FIG. 4*a* is an enlarged view of section 4a of FIG. 4.

FIG. 8 is a perspective view of the masonry wall panel shown in FIG. 7. FIG. 8*a* is an enlarged view of section 8a of FIG. 8.

DETAILED DESCRIPTION OF PREFERRED EMBODIMENTS

Figure 1A:
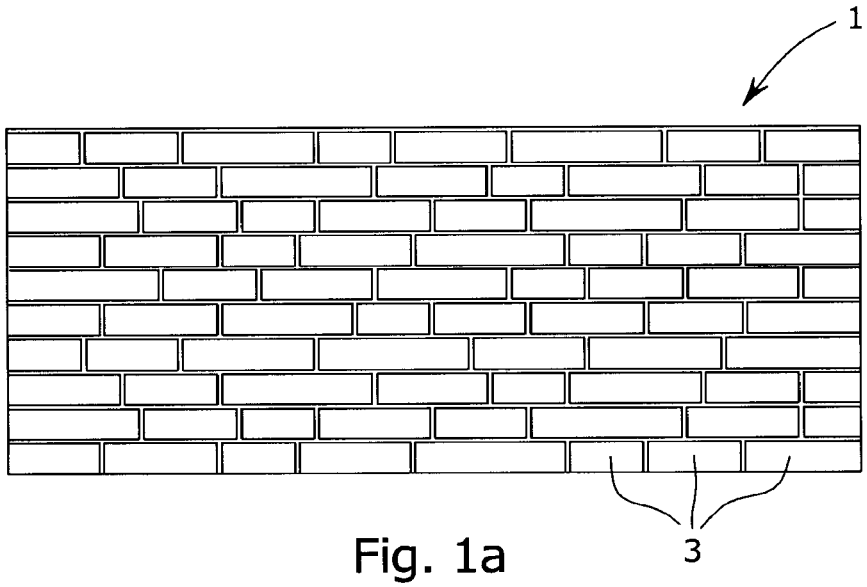
FIGS. 1*a*, 1*b*, 1*c* and 1*d* are front views of masonry wall systems, showing different patterns of masonry wall that can be obtained with a system according to preferred embodiments of the invention.

In the following description, similar features in the drawings have been given similar reference numerals and in order to lighten the figures, some elements are not referred to in some figures if they were already identified in a previous figure.

Referring to FIGS. 1*a* to 1*b*, FIG. 2, FIG. 3*a* and FIG. 7, masonry wall systems 1 according to different embodiments of the invention are shown. The figures show that various patterns with equally spaced masonry units 3 may be created using the masonry wall system. Of course, these are only a few examples of all the possible patterns that may be created.

Figure 2:
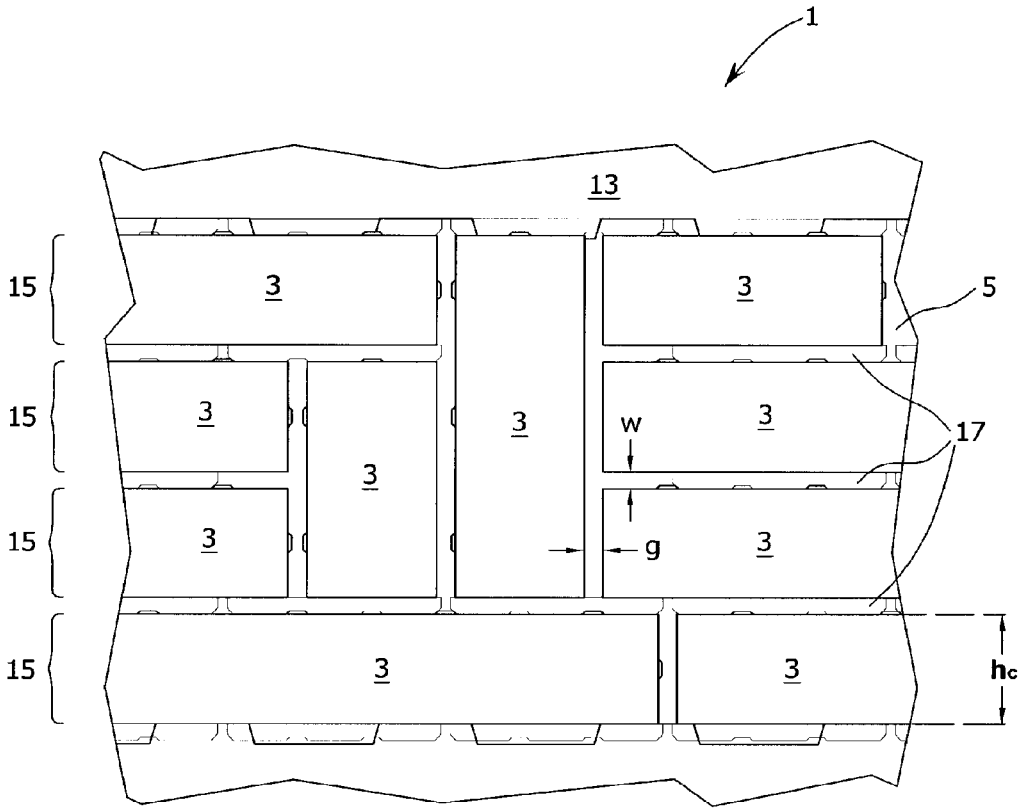
FIG. 2 is a partial front view of a masonry wall system, according to another embodiment of the invention, showing two masonry units positioned in a soldier (or upright) configuration.
Figure 5:
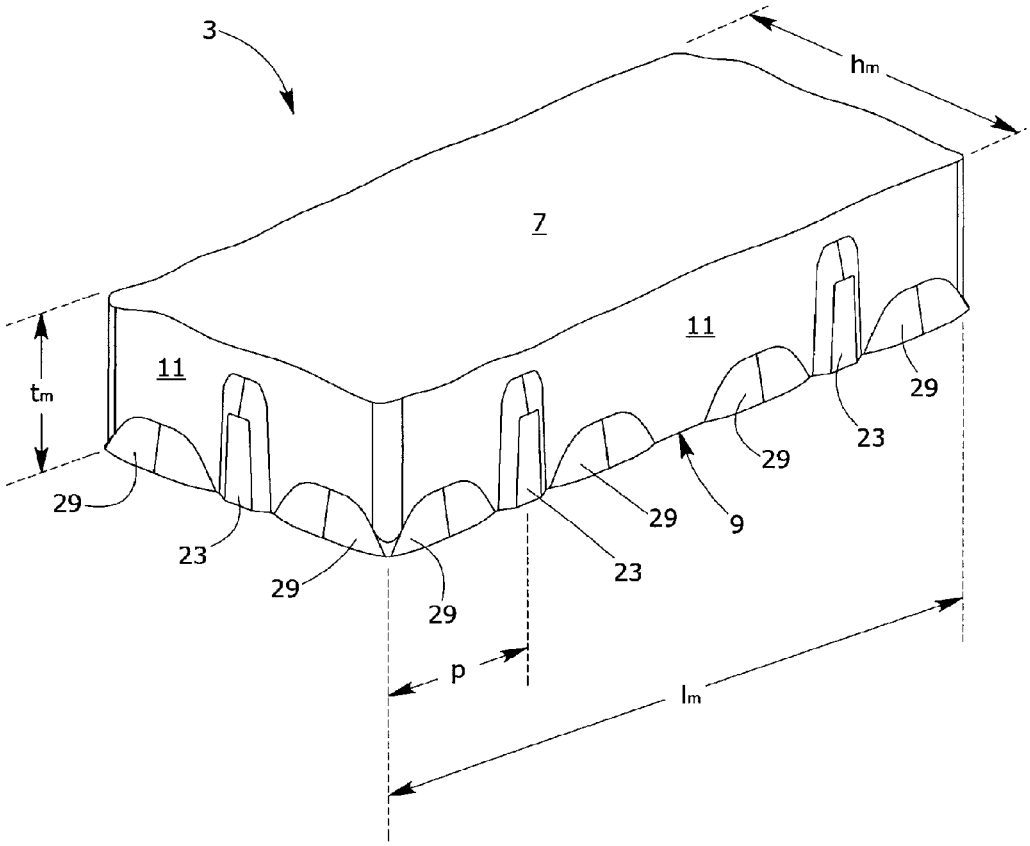
FIG. 5 is a perspective view of a first variant of an artificial masonry unit suitable for use with the masonry wall panel of FIG. 4.

Referring to FIG. 2, a system for building a masonry wall on a building surface is shown, according to a preferred embodiment. The system includes a plurality of artificial masonry units 3 and at least one panel 5. One variant of a masonry unit used with the panel 5 of FIG. 2 is shown in FIG. 5. It has a front face 7, a back face 9, and two pairs of parallel lateral faces 11, the lateral faces having a thickness $t_m$.

Referring to FIGS. 2 and 4, the panels 5 of the system have a front face 13 provided with a plurality of horizontally extending channels 15 delimited by protruding ribs 17.

The ribs are for receiving rows masonry units 3 in the channels. Preferably, the channels 15 are pre-cut in the panel, or pre-molded as the panel is being molded. Best shown in enlarged FIG. 4*a*, the ribs 17 have a predetermined width w and a predetermined thickness $t_r$ smaller that the thickness $t_m$ of the masonry units so as to leave a furrow or groove between the masonry units to receive the mortar or any other bonding material used in masonry. Thanks to the correlation between the rib guiding means and the unit guiding means, the masonry units 3, when installed in the channels 15, are spaced apart from each other by a predetermined gap g which equals the width (w) of the ribs.

While the preferred embodiments presented in the detailed description show that the vertical spacing between the units is also equal the horizontal spacing, or that, in other words, the predetermined gap g between adjacent units is equal to the width (w) of the ribs, other embodiments may provide that the gap between adjacent units in the same horizontal channels be equal to a distance (g) but be different than the width of the ribs. For example, it may be provided an embodiment where the predetermined gap between adjacent units in a channel is equal to ⅜ of an inch while the width of the ribs equals ¾ of an inch.

Still referring to FIGS. 2 and 4, these panels 5 are preferably made of polystyrene or any other compressible material known in the art and which are commonly used in this field. Of course, other materials, such as different types of plastic, or even metal, may also be used. The panels 5 are mountable side by side on a building surface and securable to the surface with wall-ties (not shown in the figures), the back face of the panels 5 facing the building surface. The front face 13 of the panel 5 may also be provided with indicators (not shown in the figures) for indicating where the wall-ties can be positioned when securing the panels 5 to building surface. The horizontal and vertical edges of the panels are devised such that they can be fitted with the edges of a neighboring panel 5. Best shown in FIG. 4, the top horizontal edge of the panel has a patterned contour 14 that can fit with the contour of the bottom horizontal edge of a similar panel.

Advantageously, the back face of the panels 5 can be provided with longitudinal ribs (not shown in the figures) for allowing water that may have infiltrated between the building surface and the panel to be drained towards a catch room at the bottom of the building surface. The space between the longitudinal ribs of the back face of the panel and the building surface forms a secondary room (not shown in the figures) where the infiltrated water may flow.

Figure 3A:
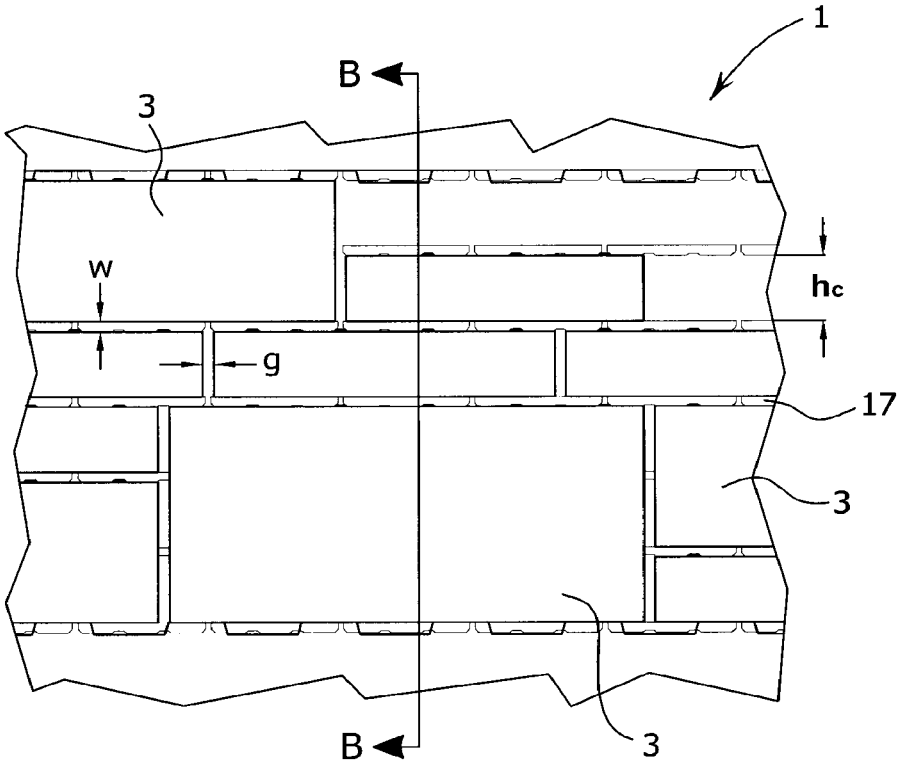
Figure 3B:
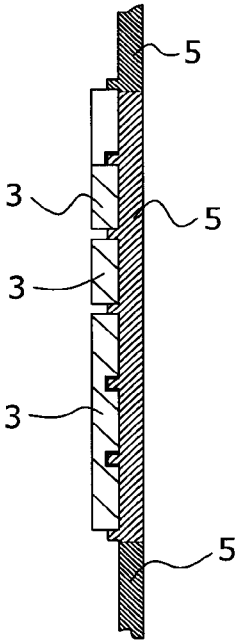
FIG. 3*b* is a cross section taken along the line B-B of FIG. 3*a*.

Now referring to FIGS. 4 and 5, rib guiding means 21 are positioned along the ribs and unit guiding means 23 are positioned along at least one of the lateral faces 11 of the masonry units 3, and preferably on two lateral sides, a long and a short side. The rib and unit guiding means 21, 23 are interdependently positioned so as to guide the installation of the masonry units 3 in the channels 15 in such a way that the gap g (as shown in FIG. 3*a*) between two adjacent masonry units 3 installed in the panel is always identical, and preferably equal to the width w. The rib and unit guiding means are said thus to be "interdependently positioned" because the positioning of both the rib and unit guiding means on the ribs and units is a function of the gap g. In its simplest form, the rib and unit guiding means 21, 23 may consist of marks or indicators interdependently positioned on the ribs and on the units but preferably, each of the rib guiding means 21 is interlockable with each of the unit guiding means 23. This interlocking of the rib and unit guiding means 21, 23 preferably provides a mechanical connection of the units 3 with the ribs 17 of the panel 5. Of course, in other embodiments, the unit guiding means do not need to be in physical contact with the unit guiding means. A thin spacing may remain between the unit and the rib guiding means when facing each other.

Still preferably, and as shown in the embodiments shown in FIGS. 2 to 6*a*, the rib guiding means 21 are notches and the unit guiding means 23 are protuberances shaped to snugly fit into the notches. In this preferred embodiment, the notches have the shape of a trapezoid but they may have other shapes as well.

Referring to FIG. 4, each one of the channels 15 is delimited by an upper rib and a lower rib. The rib guiding means 21 are arranged along one of the upper and lower ribs, preferably the upper rib, and are facing towards the channels 15. The guiding means 21 are uniformly spaced along the ribs 17 by a spacing s which equals to Ag, wherein A is an integer equals to or greater than 1 and g is the predetermined vertical gap, which is preferably also equal to w, the width of the ribs 17. Preferably, the spacing s between two contiguous rib guiding means 21 is always a multiple of the width w and the position of a rib guiding means 21 can be obtained by adding A*g (or in this case, A*w) to the position of the first rib guiding means 21 from the edge of a panel.

As per the illustrated embodiment of the panel of FIG. 4, the spacing s preferably corresponds to 4*g, so that the rib guiding means (in this case notches) are spaced apart by 4 times the predetermined gap g.

In this preferred embodiment, apertures 25 are practiced in the protruding ribs 17 to allow the flow of water that may have seep to the front face 13 of the panel 5 down the panel to a catch room (not shown in the figures). Preferably, as illustrated in FIG. 4, the apertures 25 are uniformly distributed on the protruding rib and their positions correspond to the notches positions.

The panels may come in various dimensions. As an example only, a suitable panel 3 may be manufactured in a 4'×8' format, but the panels of the masonry wall system may come in different sizes and the panel may be cut to easily adapt to the surface to cover.

Referring to FIG. 5, the masonry unit 3 has a length $l_m$, delimited by two opposing vertical edges, and corresponding to Bg, wherein B is a second integer equal to or greater than 2. In this description, it is considered that the length of a masonry unit 3 is measured on the longest side of the unit, regardless of its orientation in the panel 5. The height $h_m$ of a masonry unit is the shortest of the sides of the unit. In the preferred embodiment illustrated in FIGS. 2 and 3, the integer A determining the spacing s between the rib guiding means 21 is an even number while the integer B determining the length $l_m$ of the masonry units is an odd number. Of course, in other embodiments of the invention, the integer A determining the spacing s between the rib guiding means 21 may be an odd number while the integer B determining the length $l_m$ of the masonry units 3 may be an even number.

Still referring to FIG. 5, the masonry unit 3 includes at least one of the unit guiding means 23, adapted to be coupled with one of the rib guiding means 21 of the panel 5 of FIG. 4, when the masonry unit 3 is fitted in a channel 15. The unit guiding means 23 are located such that a unit guiding means position p from one of the two opposing edges corresponds to (X+C)g, wherein X is a nonnegative real number and wherein C is a third integer multiple of A. The artificial masonry unit 3 can be made of pre-cast concrete or clay, or any other suitable material.

Advantageously, as shown in FIGS. 1*a* to 1*d*, 2 and 3*a*, the artificial masonry units 3 may have various lengths $l_m$ and heights $h_m$. Indeed, the masonry units may have heights $h_m$ that are equal or greater than the height $h_c$ of the channels, their height $h_m$ being substantially equal to $M*h_c+(M-1)w$, wherein M is an integer greater or equal to 1. By substantially, it is meant that the height may vary within a tolerance of plus or minus 15%.

Figure 1B:
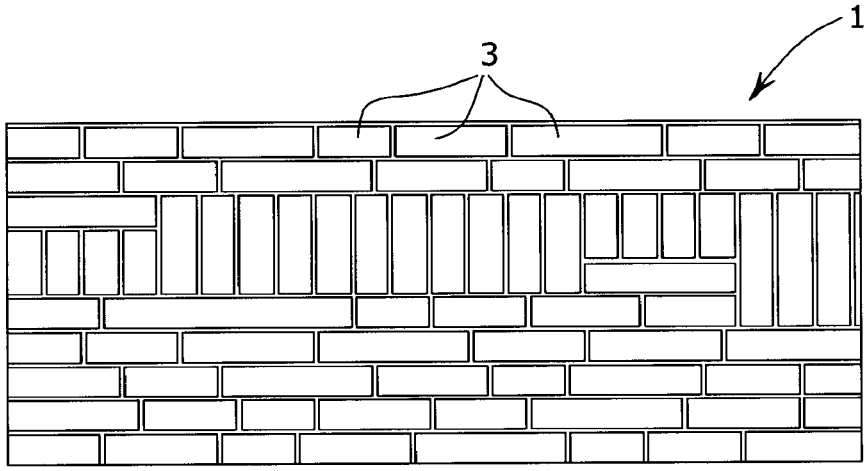
Figure 1C:
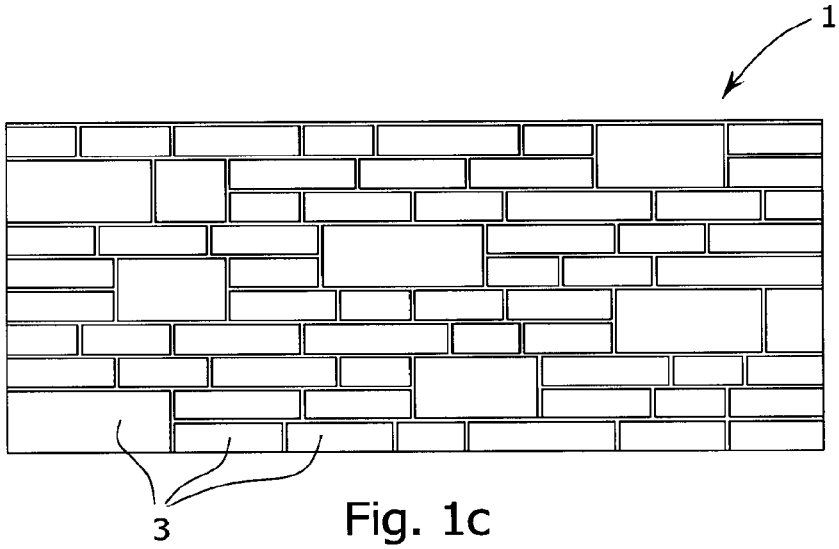
Figure 1D:
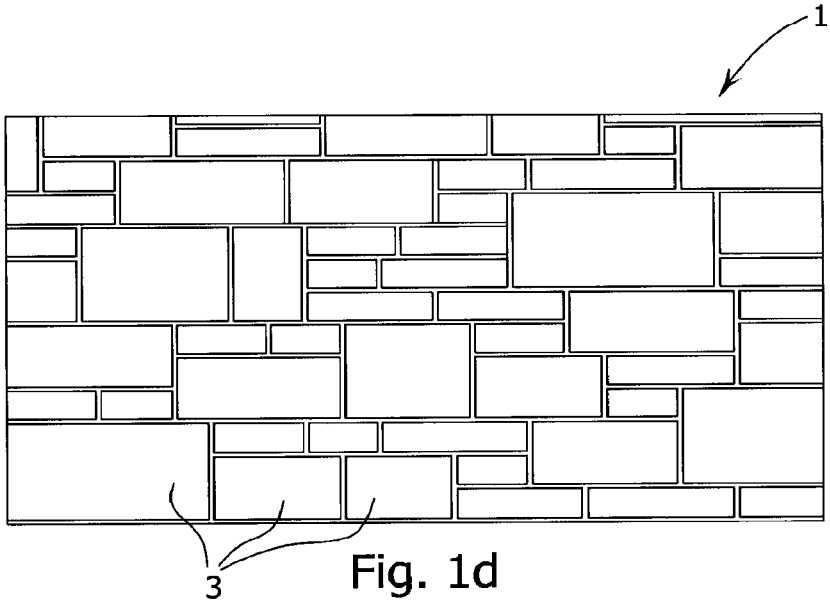

For masonry units to be positionable both horizontally and vertically (in a soldier configuration) in a panel, as such as shown in FIG. 1*b*, for example, the length $l_m$ of such masonry units is given by the formula $l_m=N*h_c+(N-1)w$, wherein N is an integer greater to or equal to 1, and $h_c$ correspond to the height of the channels.

For installing larger masonry unit 3 in a panel 5, that is when the height $h_m$ of a masonry unit 3 is greater than $h_c$, some portions of the protruding ribs 17 can be cut-away of a length corresponding to a length of such larger masonry units 3, to accommodate an insertion of said larger units 3 in the panel 5. Cutting away portions of the protruding ribs 17 may also be required when inserting masonry units 3 in a soldier orientation (uprightly), as shown in FIG. 2.

Figure 6A:
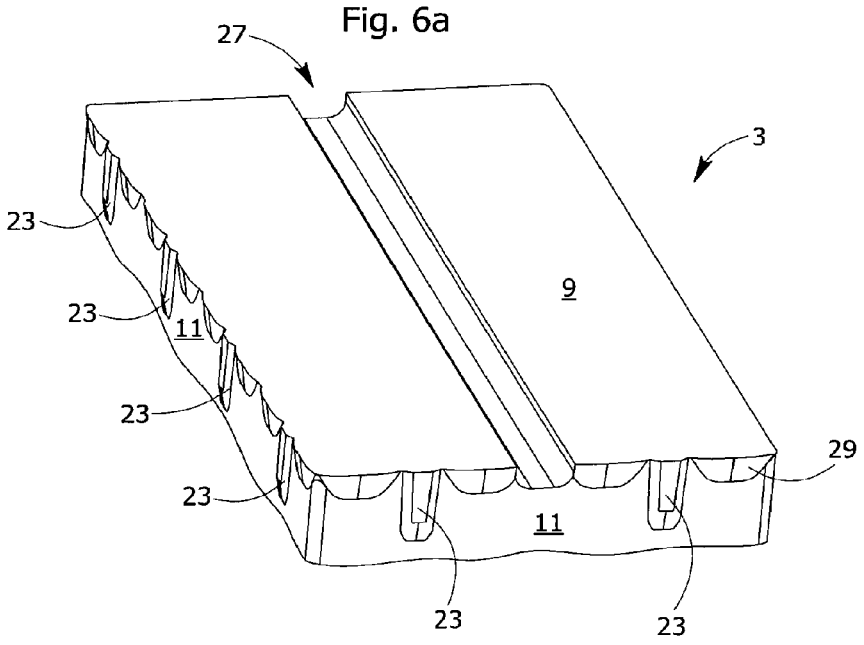
FIGS. 6*a* and 6*b* are respectively rear and front perspective views of a second preferred variant of an artificial masonry unit suitable for use with the masonry wall panel of FIG. 4.
Figure 6B:
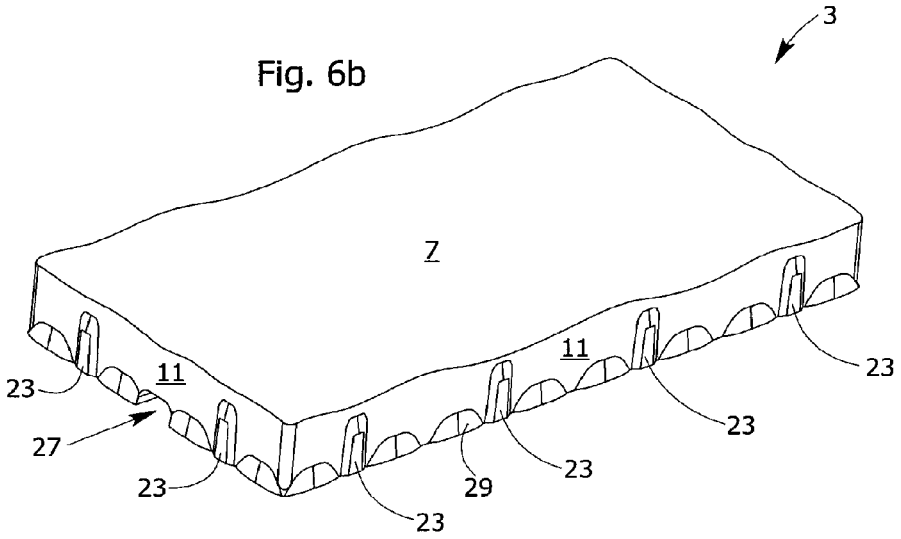

Alternatively, in order to avoid having to cut off part of the protruding ribs 17 when a masonry unit is positioned in the soldier configuration, or when the height $h_m$ of a masonry unit 3 is greater than that of the channel 15, the units 3 may be provided with one or more grooves 27 practiced on their back face 9, as shown in FIGS. 6*a* and 6*b*. The grooves 27 have a width corresponding to the width w of the ribs 17 and a depth corresponding to at least the ribs predetermined thickness $t_r$.

The grooves are located such that they each can be fitted over a corresponding one of the protruding ribs 17 when the masonry unit 3 is positioned in the panel 5.

In the preferred embodiments shown in FIGS. 1 to 6*b*, the predetermined gap g and the width w of the protruding ribs 17 are substantially equal to ½ inch, the thickness $t_r$ of the protruding rib 17 is substantially equal to ½ inch and the rib guiding means 21 on the protruding rib are spaced apart by 2 inches. Advantageously, the length 47 of the masonry units may substantially equal to 3½, 5½, 7½, 9½, 11½ or 13½ inches. Masonry units 3 for which the length corresponds to 7½ or 11½ inches may be placed in a soldier configuration. The height $h_m$ of the masonry units 3 can substantially be equal to 3½, 7½, 11½, or 15½ inches. By substantially, it is meant that these measurements may vary within a tolerance of plus or minus 15%.

Of course, other heights $h_m$ of masonry unit 3 may be chosen, such as 2¼ inches or 2¾ inches, as well as other widths w of protruding ribs 17, such as ¾ of an inch, for example.

Now referring to FIGS. 5, 6*a* and 6*b*, the artificial masonry units 3 may optionally have tooth projections 29 projecting from one of the lateral faces 11 to the back face 9 of the artificial masonry unit 3, for thrusting into one of the protruding ribs 17 defining a channel 15. The tooth projection 29 thereby helps retaining the masonry unit 3 within the channel 15 prior to mortaring the whole structure. With such tooth projection 29, there is no need for using a mixture of cement to temporarily retain the masonry units 3 into the channels 15.

FIGS. 7, 8, 9*a* and 9*b* show yet another embodiment of a masonry wall system 1 according to the present invention. In this embodiment, the rib guiding means are projecting teeth 31 and the unit guiding means 23 of each of the units are cavities 33 having a shape reminiscent to a three-quarter cylinder. Each end of the cavity 33 opens at a top one and a bottom one of the lateral faces 11 and a cut-away portion of the cavity 33 opens at the back face 9. Angles θ are formed by the back face 9 of the unit 3 and an inside surface of the cavity. The angle θ is acute for gripping sides 37 of the rib projecting teeth 31 (best shown in FIG. 8*a*) when the masonry unit 3 is installed between two ribs 17.

Figure 7:
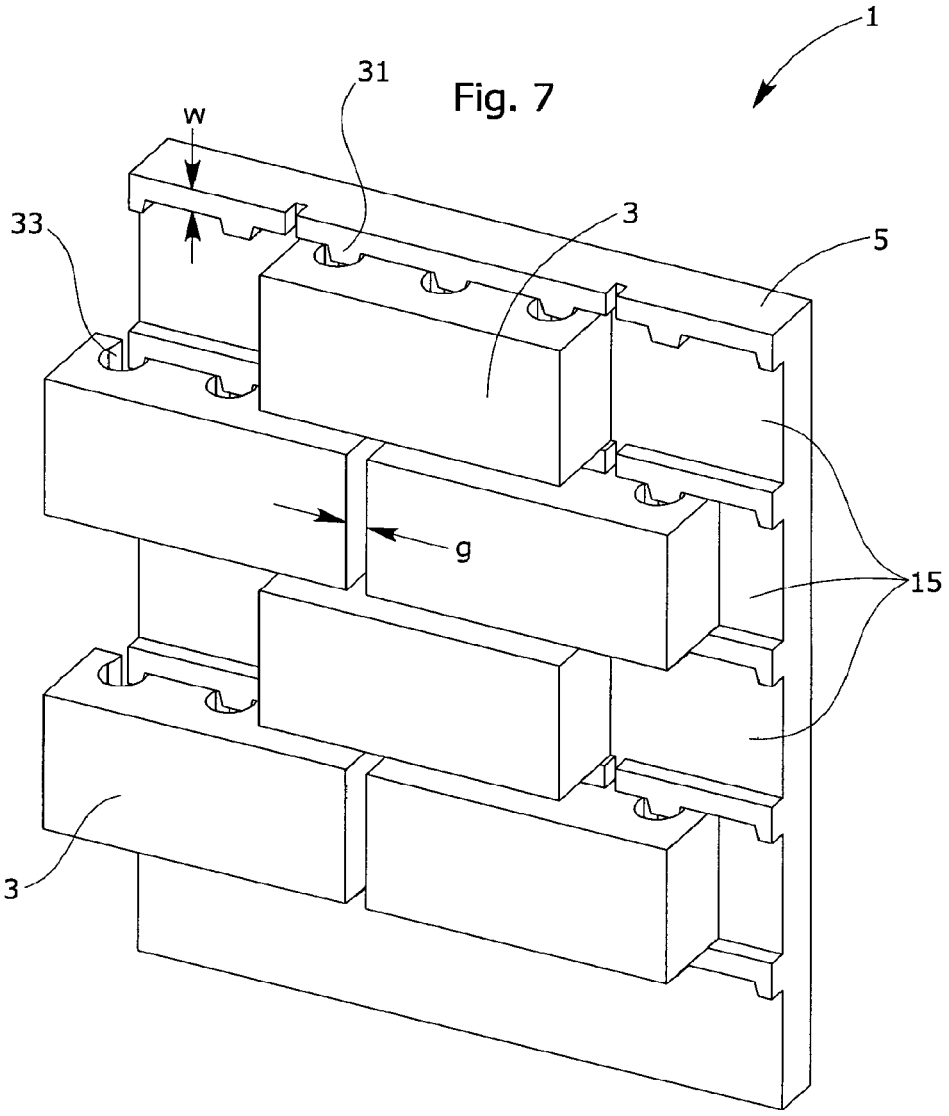
FIG. 7 is a perspective view of a masonry wall system, showing several masonry units positioned in a panel according to still another embodiment of the invention.
Figure 9A:
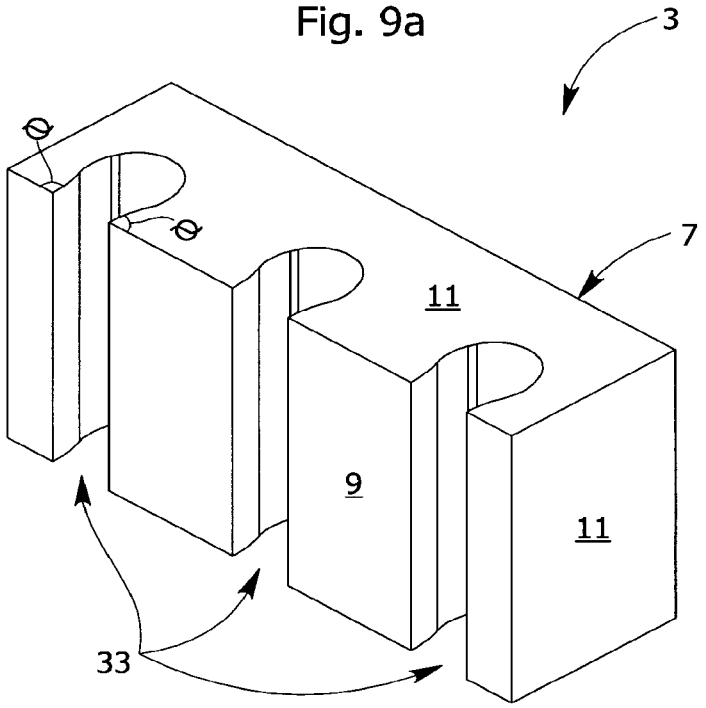
FIG. 9*a* is a perspective view of a first preferred variant of an artificial masonry unit suitable for use with the panel of FIG. 8.
Figure 9B:
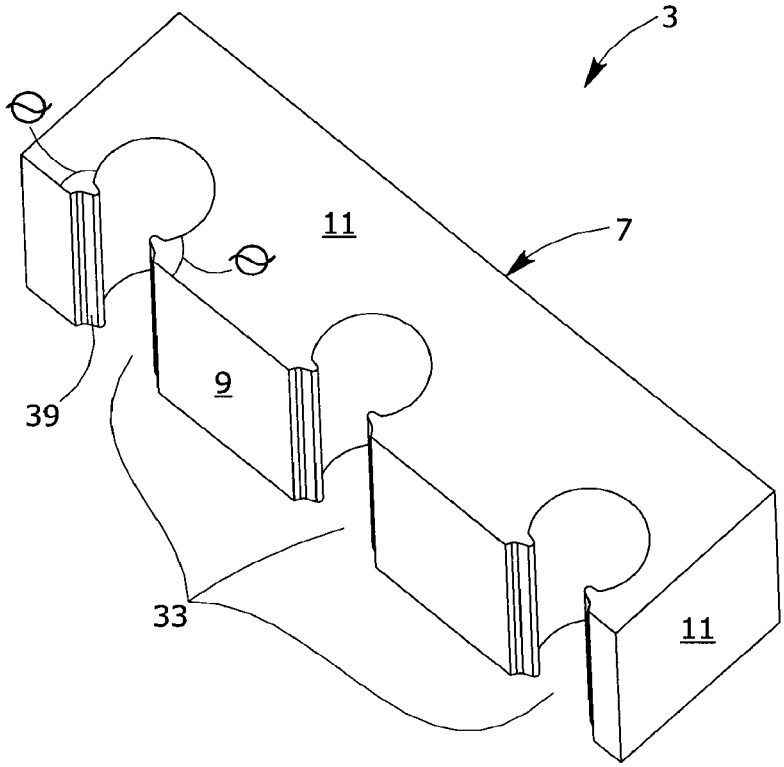
FIG. 9*b* is a perspective view of a second preferred variant of an artificial masonry unit suitable for use with the panel of FIG. 8.

FIG. 9*a* shows a first variant of a masonry unit 3 for use with the panel 5 of FIG. 7, while FIG. 9*b* shows a second variant of a masonry unit 3. The second variant illustrated in FIG. 9*b* has bulges 39 that may help gripping the sides 37 of the projecting teeth 31. In this preferred embodiment, the rib and unit guiding means 21, 23 not only facilitate the positioning of the units 3 in the panels 5, but also advantageously allows the unit 3 to stay in place in the channels 15 prior mortaring the units, thus eliminating the need to have tooth projections 29 for gripping the protruding ribs 17.

Although not shown in the figures, this preferred embodiment may also includes masonry units 3 of different sizes, such various sizes being multiples of the predetermined gap, ensuring a constant spacing equal to g between the units.

One will appreciate that the position of the unit guiding means 23 on the masonry units 3, the length $l_m$ and height $h_m$ of the masonry units 3, the spacing s of the rib guiding means 21 on the protruding ribs 17 and the position of the grooves 27 at the back 9 of the masonry units 3 are all devised such that the gap g between two side-by-side masonry units 3 fitted in the channels 15 is always identical. In other words, these relations ensure that the vertical joint width between two adjacent masonry units 3 placed in the panels 5 of this masonry wall system 1 is always identical or substantially identical.

In accordance with another aspect of the invention, there is provided a method for installing a masonry unit wall system 1 including components as described above.

In accordance with this method, and referring to FIGS. 1*a* to 9*b*, a panel 5 is first secured on a building surface, its back face 9 facing the building surface. Wall-ties for tying the panel 5 to the wall surface are installed at the positions indicated by the indicators (not shown in figures). Once a first panel 5 is secured, other panels 5 are fitted at their edges with the previous panel 5 installed and are secured as described above. This step is repeated until the wall surface is completely covered with panels 5. The panels 5 can advantageously be cut when they are installed around doors and windows or when they are installed near the edges of the building surface to cover.

Masonry units 3 are then inserted into each of the channel 15 of the panels 5, forming rows of side by side masonry units 3. Each of the masonry units 3 is positioned by coupling one of its unit guiding means 23 with one rib guiding means 21 of the protruding ribs 17, therefore forming rows of masonry units spaced apart from each other by a predetermined gap g. Optionally, tooth projections 29 of the masonry units 3 are thrusted under the upper protruding rib 17 of the channel 15 in order to retain the masonry unit 3 in place. If such tooth projections 29 are not present on the masonry units 3, the units 3 may be secured by any other convenient means, such as with adhesive placed at on the back surface 9 of the units 3.

Advantageously, a single pattern or various different patterns can be followed when inserting the masonry units 3 in the panel 5. The masonry units 3 can also be cut to go around doors or windows or when they are placed near the edge of the building surface.

Soldier masonry units may be installed horizontally or vertically in the panels. Masonry units placed in the soldier configuration or units for which the height $h_m$ is greater than the height $h_c$ of the channel 15 are installed such that their grooves 27 are fitted around the protruding ribs 17 of the channels.

Once the panel is completely filled with masonry units 3, mortar material is inserted in between adjacent artificial masonry units for binding the masonry units together.

Of course, numerous modifications could be made to the embodiments above without departing from the scope of the present invention.

The invention claimed is:

1. A system for building a masonry wall on a building surface, the system comprising:

a plurality of artificial masonry units, each one of said masonry units having a front face, a back face, and two pairs of parallel lateral faces having a thickness ($t_m$);

at least one panel having a front face provided with a plurality of horizontally extending channels delimited by protruding ribs for receiving rows of said masonry units in the channels, said ribs having a predetermined thickness ($t_r$) smaller than said thickness ($t_m$) of the masonry units, wherein each of said channels is delimited by an upper rib and a lower rib of the protruding ribs;

rib guiding means comprising projecting teeth positioned along one of the upper rib and the lower rib of each of said channels and facing toward each of said channels; and unit guiding means positioned along one of the lateral faces of the masonry units, wherein the unit guiding means comprises at least one cavity that is partially enclosed along the back face by a pair of bulges, wherein angles formed by the back face of the masonry unit and each bulge are acute for gripping sides of the projecting teeth when said masonry unit is installed between two ribs;

wherein the single masonry unit lateral face comprising the unit guiding means is engaged by the rib guiding means and the remaining faces of the masonry unit are not engaged by the rib guiding means, said rib and said unit guiding means being interdependently positioned for guiding the installation of the masonry units in the channels so that horizontally-arranged masonry units are equally spaced-apart from each other by a predetermined gap (g).

2. The system according to claim 1, wherein:

the rib guiding means are uniformly spaced along one of the upper rib and the lower rib of each of said channels by a spacing (s) corresponding to Ag, wherein A is an integer equal to or greater than 1, said rib guiding means facing said one channel;

each one of said masonry units has a length ($l_m$) delimited by two opposing vertical edges and corresponding to Bg, wherein B is a second integer equal to or greater than 2, each one of said masonry units comprising at least one of said unit guiding means adapted to be coupled with one of the rib guiding means when the masonry unit is fitted in the channel, said at least one unit guiding means being located such that a unit guiding means position (p) from one of the two opposing edges corresponds to (X+C)g, wherein X is a nonnegative real number and wherein C is a third integer multiple of A.

3. The system according to claim 2, wherein the gap (g) is substantially equal to 0.5 inches; the length ($l_m$) of the masonry units is substantially equal to 3.5 inches, 5.5 inches, 7.5 inches, 9.5 inches, 11.5 inches, or 13.5 inches; and the spacing (s) of the rib guiding means is substantially equal to 2 inches.

4. The system according to claim 2, wherein a height ($h_m$) of a number of masonry units substantially equals 3.5 inches.

5. The system according to claim 1, wherein:

said ribs have a predetermined width (w); and the gap (g) between the masonry units is substantially equal to the predetermined width (w) of the ribs.

6. The system according to claim 5, wherein the channels have a height ($h_c$) and the masonry units have a height ($h_m$), wherein the height ($h_m$) is substantially equal to:

$$M*h_c+(M-1)w,$$

wherein M is an integer greater than or equal to 1.

7. The system according to claim 6, wherein the height ($h_m$) of at least one of said masonry units, hereinafter referred to as "at least one larger masonry unit", is greater than the height ($h_c$), the at least one larger masonry unit comprising at least one groove on the back face having a width corresponding to the width (w) of the ribs and a depth corresponding to the predetermined thickness ($t_r$) of the ribs, said at least one groove being located such that it can be fitted over a corresponding one of the protruding ribs when the at least one larger masonry unit is positioned in the panel.

8. The system according to claim 7, wherein the height ($h_m$) is substantially equal to 7.5 inches, 11.5 inches, or 15.5 inches.

9. The system according to claim 6, wherein the height ($h_m$) of at least one of said masonry units, hereinafter referred to as "at least one larger masonry unit", is greater than the height ($h_c$), and some of the protruding ribs of the panel have cut-away portions of a length corresponding to a length ($l_m$) of the at least one larger masonry unit, to accommodate an insertion of the at least one larger masonry unit in the panel.

10. The system according to claim 5, wherein at least some of the masonry units are positionable both horizontally and vertically in the panel, a length ($l_m$) of said masonry units being given by the formula:

$l_m=N*h_c+(N-1)w$, wherein N is an integer greater than or equal to 1, and $h_c$ corresponds to a height of one of the channels.

11. The system according to claim 4, wherein each of the rib guiding means is interlockable with each of the unit guiding means, thereby providing a mechanical connection of the masonry units with the ribs of the panel.

12. The system according to claim 1, wherein the gap (g) is substantially equal to 0.5 inches.

* * * * *